United States Patent [19]

Sorenson

[11] 4,399,915

[45] Aug. 23, 1983

[54] MACHINE FOLDABLE CORNER POST

[75] Inventor: John F. Sorenson, St. Paul, Minn.

[73] Assignee: Champion International Corporation, Stamford, Conn.

[21] Appl. No.: 311,799

[22] Filed: Oct. 15, 1981

[51] Int. Cl.[3] ..... B65D 81/02

[52] U.S. Cl. ..... 206/586; 206/453

[58] Field of Search ..... 206/586, 587, 591, 453

[56] References Cited

U.S. PATENT DOCUMENTS

| | | | |
|---|---|---|---|
| 3,221,973 | 12/1965 | Kalbrener | 206/586 |
| 3,536,245 | 10/1970 | Palmer | 206/586 |
| 3,613,985 | 10/1971 | Goodsite | 206/586 |
| 3,708,101 | 1/1973 | McDanield | 206/586 |
| 3,957,196 | 5/1976 | Kellerman | 206/586 |
| 4,027,817 | 6/1977 | Fremion | 206/586 |
| 4,226,327 | 10/1980 | Ballard | 206/586 |

*Primary Examiner*—Joseph Man-Fu Moy

*Attorney, Agent, or Firm*—Evelyn M. Sommer; William W. Jones; John H. Mulholland

[57] ABSTRACT

A corner post made of folded corrugated paperboard is inserted into the corner areas of cartons containing, for example, large appliances, such as stoves, refrigerators, washing machines, or the like. The corner post is a multi ply device which ensures that there will be adequate space between the appliance and the carton wall, and which provides strength for the carton so that multiple filled cartons can be stacked on top of each other. The post is provided with fold lines which are made up of alternating cuts and scores to provide for easy folding of the post. The post is machine folded and glued to a flattened form which is suitable for bulk shipment. The post is easily transformed from the flattened to the erected form and inserted into the corner areas of the cartons.

7 Claims, 7 Drawing Figures

MACHINE FOLDABLE CORNER POST

This invention relates to an improved corner post construction for use in cartons containing large appliances. The corner post or other article is made from folded double wall corrugated paperboard which is machine formed and glued.

When large appliances are packaged in cardboard cartons for shipment and storage, it is conventional to insert folded corrugated paperboard corner posts into the cartons at the corners. These corner posts are generally L-shaped and are sandwiched between the corners of the appliance and the corresponding corners of the carton. The corner posts ensure that a cushioning space exists between the outer surfaces of the appliance, and the inner surfaces of the carton. The corner posts also provide considerable strength to the cartons so that the cartons can be stacked one on top of the other for storage or shipment without damaging the appliances in the cartons.

The corner posts referred to above are conventionally made from a blank of double wall corrugated board for additional bulk and strength. The blank is provided with a plurality of score lines about which the blank is folded into the erected L-shaped configuration. The final folding and insertion of the corner posts into the carton is done by the appliance manufacturer when the appliance is packed. The corner post blanks are conventionally shipped in bulk supply from the manufacturer thereof to the appliance manufacturer either in an unfolded, unglued flat condition, or in a partially folded and glued flat condition. When the blanks are shipped in the unglued, unfolded condition, they must be manually folded to the L-shaped operative condition at the point of appliance packing. When the blanks are shipped in the glued, partially folded flat condition, the final folding operation to form the operative L-shaped configuration is performed manually at the point of appliance packaging.

Since the material from which the corner posts are made is a double wall corrugated paperboard, of substantial thickness, it will be appreciated that the manual folding operation necessary to form the operative L-shaped configuration is a difficult task since the thick material is difficult to fold even after it has been scored. The final fold is particularly difficult because it must be made in a two to three ply composite formed by the preliminary folding of the double wall blank. In the case of the machine folded and glued bulk shipment flat forms, the machinery needed to fold and glue and blanks to this bulk shipment form is highly specialized and expensive due to the heavy material being folded, and this material, when merely scored, cannot be folded and glued by conventional carton making machinery.

The corner post construction of this invention is an improvement over the above-noted prior art corner post constructions in that it may be pre-glued and folded into the flat bulk shipment form by ordinary carton forming machinery. Furthermore, the corner post erecting folding operation which forms the L-shaped configuration is easier to perform than with the prior art corner posts. The improved foldability of the corner post of this invention is accomplished by providing combination cut and scored fold lines in the corner post blank. The fold lines are formed as alternating scored and cut lines, so that each fold line will be made up of a scored portion followed by a cut portion, followed by another scored portion, followed by another cut portion, and so on. At the medial fold, which connects the two legs of the corner post, which involves a folding of two layers of material, each of which is of two corrugations in thickness, the cut and scored portions of the fold line on one of the adjacent layers are staggered with respect to the cut and scored portions of the fold line on the other of the adjacent layers, so that the cut portions on one layer are aligned with the scored portions on the other layer. The net effect is that the resistance to folding of the medial fold is much reduced, but the fold is a solid fold due to the nesting of the scored portions of one layer into the cut portions of the adjacent layer.

It is, therefore, an object of this invention to provide a corner post assembly constructed of folded multi-wall corrugated paperboard, which corner post is inserted into a large appliance carton to strengthen the corners of the carton.

It is a further object of this invention to provide a corner post assembly of the character described which can be machine glued and folded to a flattened bulk shipping configuration, with the folding and gluing operations being performable by a conventional carton forming machine.

It is an additional object to provide a corner post of the character described wherein the final folding operation to form the operative L-shaped configuration can be easily performed due to the provision of a pair of inner alternately interrupted fold lines on the adjacent plies of the flattened configuration.

These and other objects and advantages of the invention will become more readily apparent from the following detailed description of two preferred embodiments of the invention, taken in conjunction with the accompanying drawings, in which.

Figure 1:
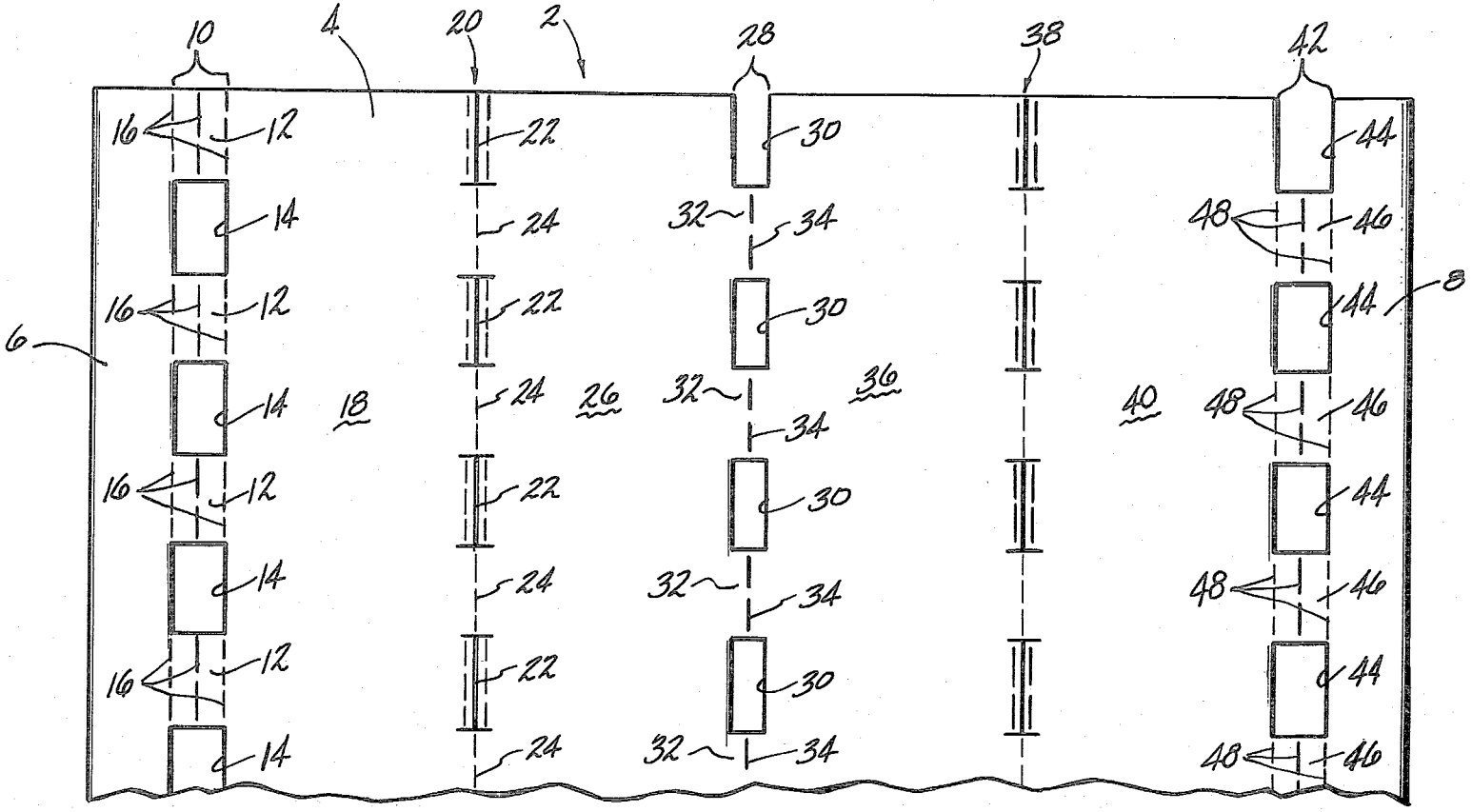
FIG. 1 is a plan view of a portion of a blank formed from double wall corrugated paperboard, from which a partial overlap corner post formed in accordance with this invention can be erected.
Figure 2:
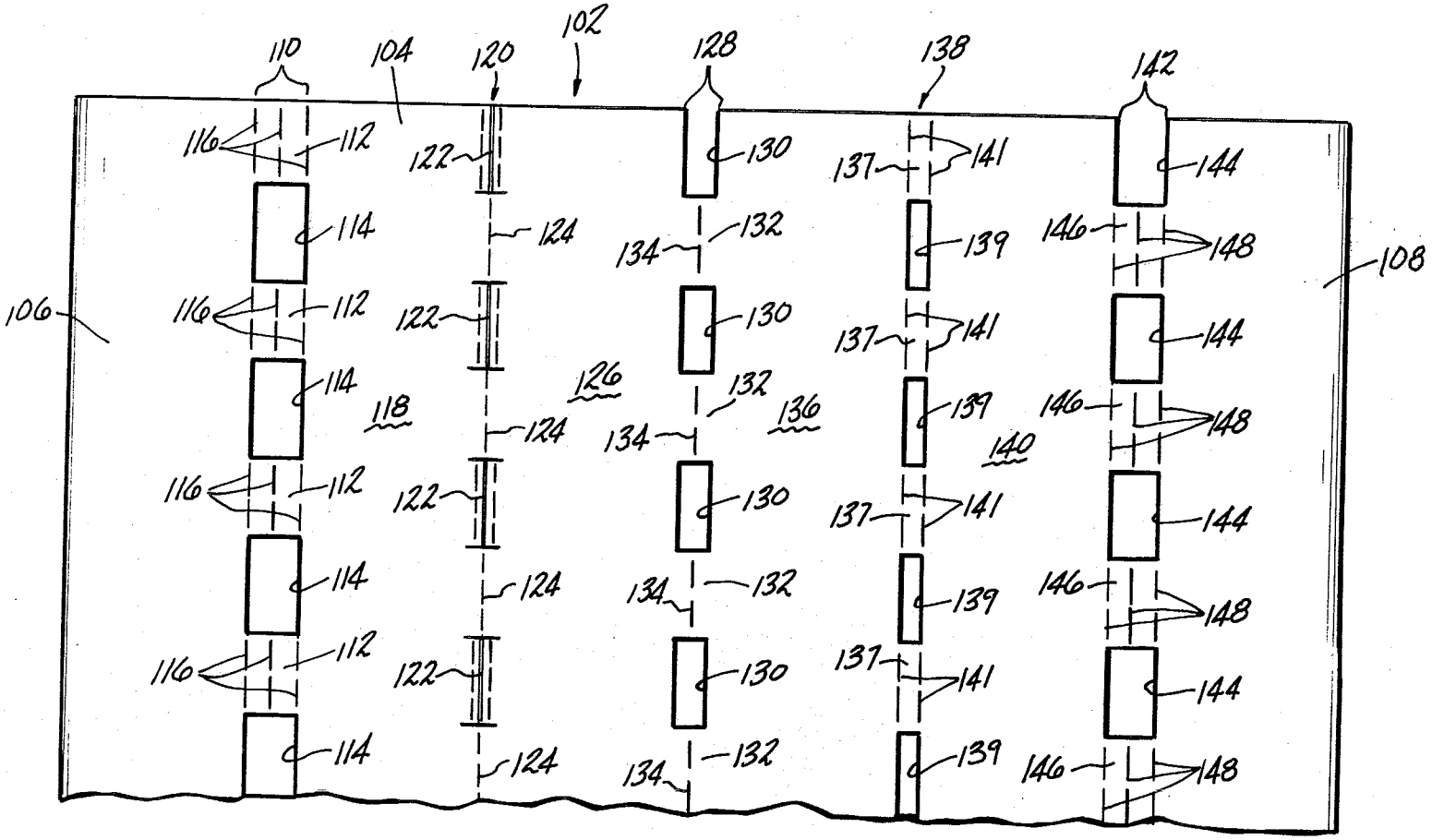
FIG. 2 is a plan view of a portion of a blank similar to FIG. 1, from which a full overlap corner post formed in accordance with this invention can be erected.

Referring now to the drawings, there is shown in FIGS. 1 and 2 two embodiments of blanks, denoted generally by the numerals 2 and 102 respectively, from which embodiments of corner posts of this invention can be formed. Each blank 2 and 102 is formed from a sheet of two ply corrugated paperboard 4 and 104. The blanks 2 and 102 include a pair of end glue flaps 6, 8 and 106, 108. Adjacent to the glue flaps 6 and 106, there is disposed an axially extending folding zone 10 and 110. The folding zones 10 and 110 are made up of alternating straps 12 and 112, and rectangular cut out holes 14 and 114. Across each strap 12 and 112 there extends three parallel scored fold lines 16 and 116. Inwardly of the folding zones 10 and 110 there are disposed first panels 18 and 118 which extend to fold lines 20 and 120. The fold lines 20 and 120 are formed from alternating H-shaped cuts and scored folds 22, 24 and 122, 124 respectively. Inwardly of the fold lines 20 and 120, there are disposed second panels 26 and 126 which extend to folding zones 28 and 128. The folding zones 28 and 128 are formed from alternating rectangular cut out holes 30 and 130 and straps 32, 132. Across each strap 32, 132 there extends a single medial scored fold 34, 134. It will be noted that the straps 12, 112 in the folding zone 10, 110 are aligned with the cut out holes 30, 130 in the folding zone 28, 128. Likewise, the straps 32, 132 in the folding zone 28, 128 are aligned with the cut out holes 14, 114 in the folding zone 10, 110. Adjacent to the folding zones 28, 128 there are disposed third panels 36, 136. The third panel 36 on the blank 2 extends to a fold line 38 which is similar in construction to the fold line 20. The third panel 136 extends to a fold line 138 which is made up of alternating folds 137 and rectangular cut out holes 139. The folds 137 include parallel score lines 141. Adjacent to the fold lines 38, 138 there is disposed a fourth panel 40, 140 which extends to a folding zone 42, 142 which includes alternating rectangular cut out holes 44, 144 and straps 46, 146. Each strap 46, 146 includes three scored fold lines 48, 148 extending thereacross. It will be noted that the straps 46, 146 of the folding zone 42, 142 are aligned with the rectangular cut out holes 14, 114 in the folding zone 10, 110. Also, the rectangular cut out holes 44, 144 in the folding zone 42, 142 are aligned with the straps 12, 112 in the folding zone 10, 110.

Figure 3:
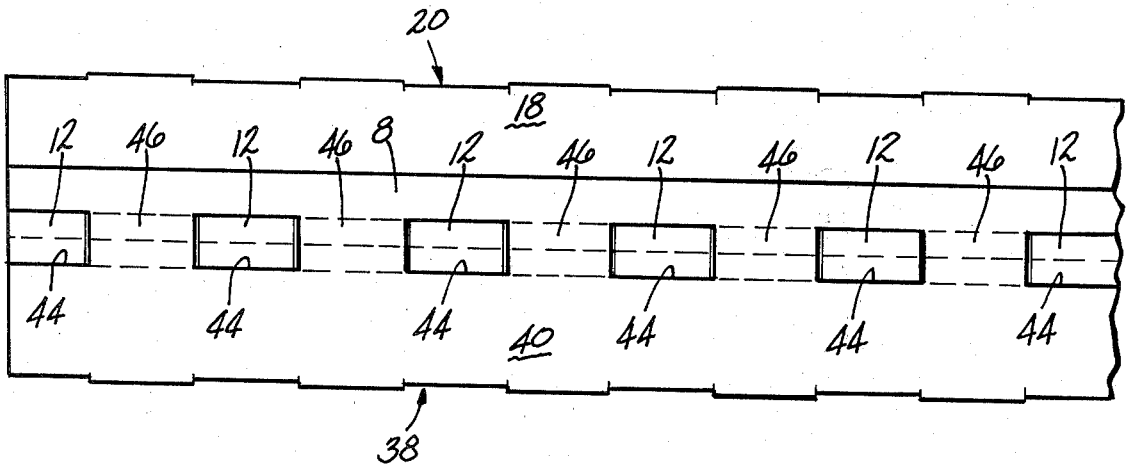
FIG. 3 is a plan view of a portion of the flattened bulk shipment configuration of the corner post formed from the blank of FIG. 1, which has been machine folded and glued.

The blank of FIG. 1 is folded and glued to form the flattened bulk shipping configuration of the corner post shown in FIG. 3 as follows. The panel 18 is folded about the fold line 20 to bring the folding zone 10 into overlying relationship with the folding zone 28. The panel 40 is then folded about the fold line 38 to bring the folding zone 42 into overlying relationship with the folding zone 10 and the flap 8 is glued to the panel 18 adjacent to the folding zone 10. As can be seen in FIG. 3, when the corner post is in the flattened condition, the straps 12 in the folding zone 10 are in registry with the rectangular cut out holes 44 in the folding zone 42. Additionally, the straps 46 in the folding zone 42 are in registry with the underlying rectangular cut out holes 14 in the folding zone 10. As previously noted, the corner posts are shipped and stored in the flattened form shown in FIG. 3.

Figure 4:
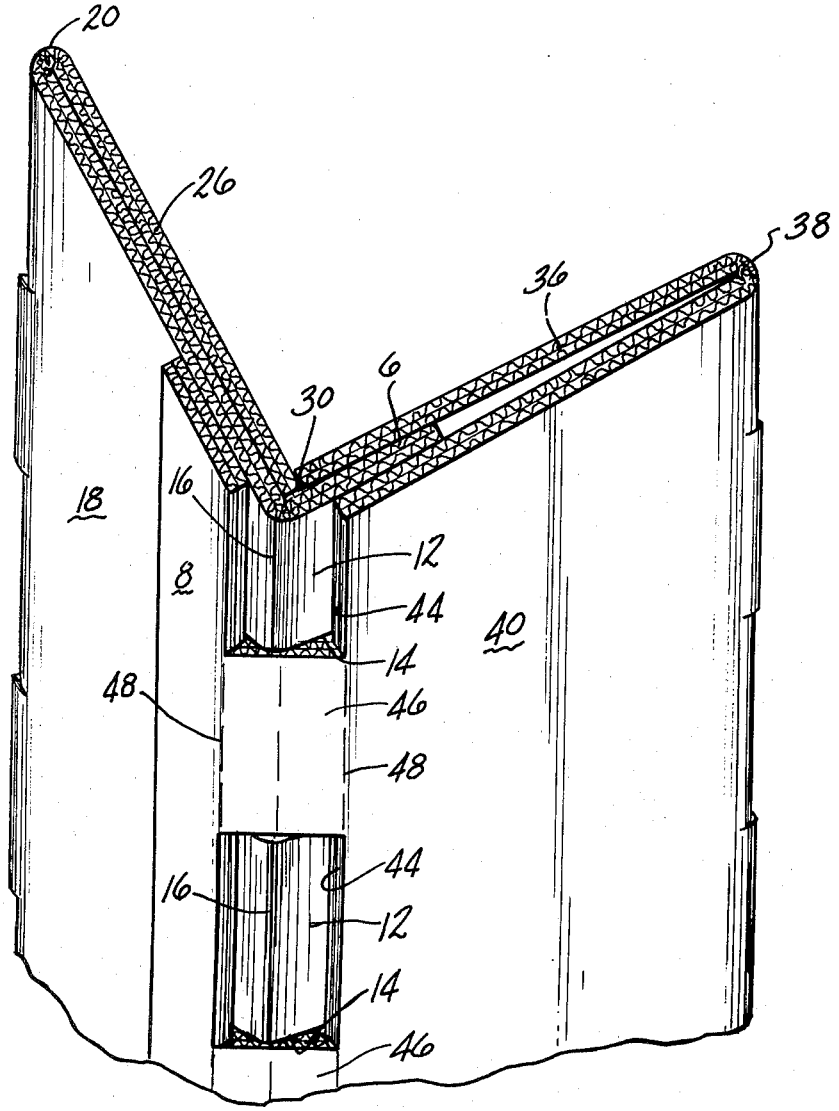
FIG. 4 is a perspective view of a portion of the corner post formed from the flattened configuration of FIG. 3 and folded into its operative L-shaped configuration.

The flattened corner post is erected to its operable L-shaped form by grasping the adjacent panels 36, 40 and 18, 26 and bending the corner post about the adjacent folding zones 10, 28 and 42. It will be noted that, when in the erected L-shaped form, as shown in FIG. 4, the inner rectangular cut out holes 30 in the inner folding zone 28 will close up. The straps 12 in the folding zone 10 will bend about the middle scored fold lines 16 and project into the rectangular cut out holes 44 in the folding zone 42. At the same time, the straps 46 in the folding zone 42 will bend about the outer scored fold lines 48 and extend through the rectangular cut out holes 14 in the folding zone 10. It will be readily appreciated that the nesting of the straps 12 and 46 in the rectangular cut out holes 44 and 14 respectively allows the flattened corner post to be easily erected into its operable L-shaped form. It will be noted that the flap 8, and panels 18 and 26 provide a three ply material thickness on one side of the inner fold, as do the flap 6 and panels 36 and 40 on the other side. It will be appreciated that three ply double corrugated paperboard material is quite difficult to easily and sharply fold without the unique strap cut-out folding zones of this invention.

Figure 6:
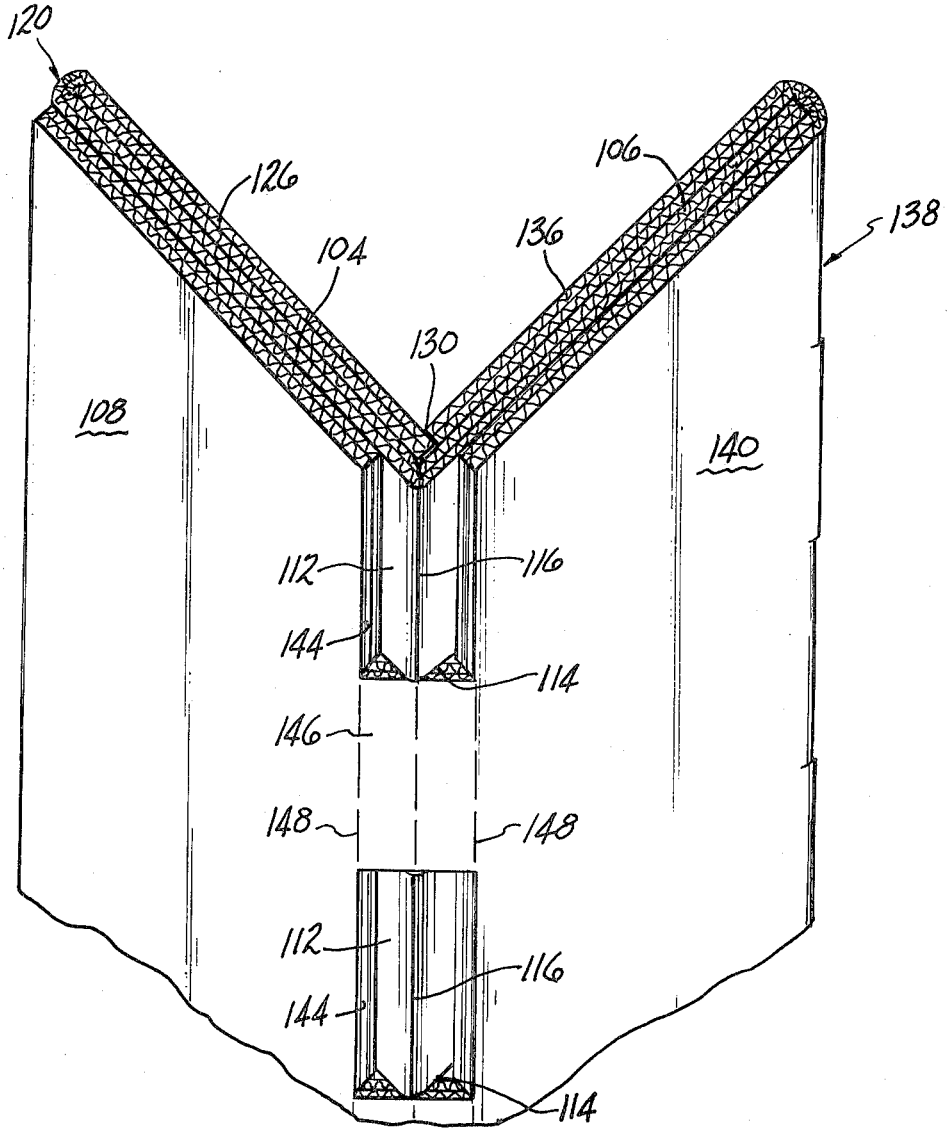
FIG. 6 is a perspective view of a portion of the corner post formed from the flattened configuration of FIG. 5 and folded into its operative L-shaped configuration.
Figure 5:
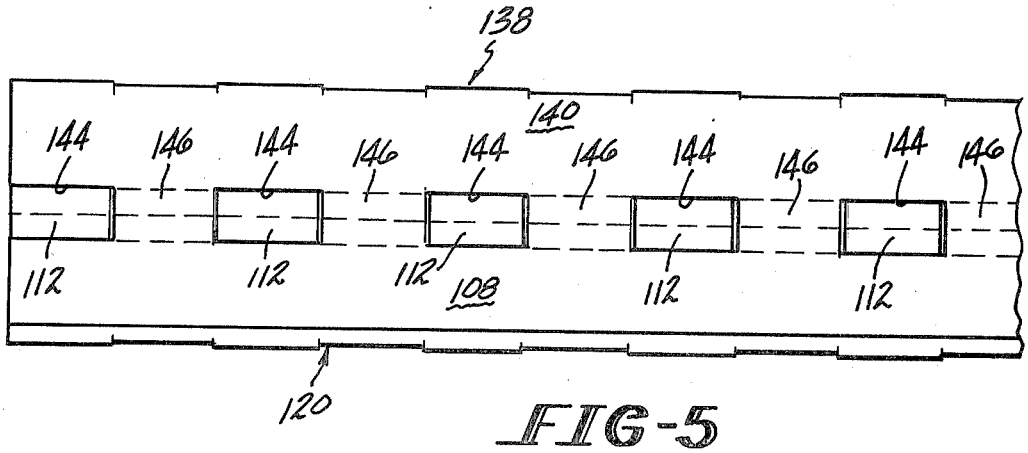
FIG. 5 is a plan view of a portion of the flattened bulk shipment configuration of the corner post formed from the blank of FIG. 2, which has been machine folded and glued.

Referring now to FIGS. 2 and 5, the blank 102 of FIG. 2 is formed into the flattened corner post configuration of FIG. 5 as follows. The flap 106 and first panel 104 are folded about the fold line 120 so as to overlie the second panel 126 and third panel 136. It will be noted that the flap 106 is, in effect, a full width panel so that the free edge of the flap 106 will lie adjacent to the fold line 138. The fold line 138 is formed from cut outs 139 and intermittent scored lines 141 so as to accommodate the close proximity of the free edge of the flap 106. The fourth panel 140 and flap 108 are then folded about the fold line 138 so as to overlie the flap 106 and first panel 118, and the flap 108 is glued to the first panel 118 thereby forming the flattened form of the corner post shown in FIG. 5. The flattened corner post is erected to its L-shaped operable form by grasping the overlain panels 108, 118 and 126 on one hand and grasping the overlain panels 106, 126 and 136 on the other, and bending the flattened form about the overlain folding zones 110, 128 and 142. When in the L-shaped form, the straps 112 will bend about the middle scored line 116 and project through the rectangular cut out holes 144, and the straps 146 will bend about the outer scored lines 148 and extend across the rectangular cut out holes 114. It will be noted that the embodiment of FIGS. 2, 5 and 6 provides full length three ply material along the entire extent of each leg of the L-shaped erected form. Thus additional cushioning, spacing and strength is provided with the full overlap embodiment.

Figure 7:
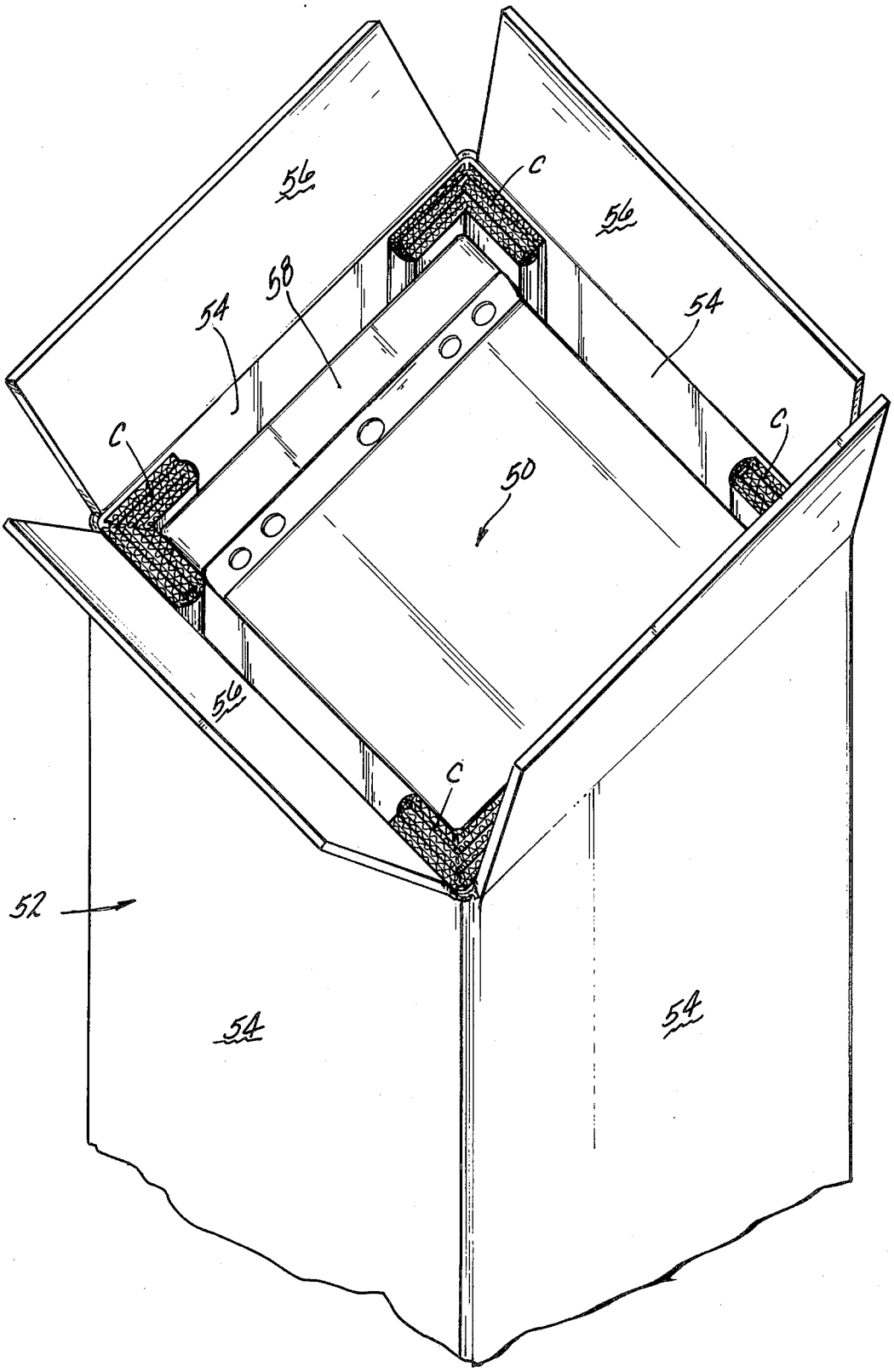
FIG. 7 is a perspective view of a portion of a carton containing a large appliance into which the corner posts of this invention have been inserted.

Referring now to FIG. 7, there is shown a large appliance 50, such as a washer or dryer, disposed in a corrugated paperboard carton 52, with the full overlap corner posts C sandwiched between each corner of the appliance 50 and each corner of the carton 52. It will be noted that the corner posts C ensure that there will be adequate spacing between the carton side walls 54 and the sides of the appliance 50 to protect the appliance 50. Furthermore, the corner posts C project above the uppermost surface 58 on the appliance 50 so as to terminate at the underside of the top closure flaps 56 of the carton 52. Thus the corner posts C provide strength to the carton 52 so that a plurality of cartons can be stacked on top of each other without damaging the appliances in the cartons.

It will be readily appreciated that the corner posts of this invention are readily formed from a corrugated paperboard blank to a flattened bulk shipping form which is pre-folded and glued by means of conventional carton forming machinery. The flattened form can be easily folded into its erected operable L-shaped form for insertion into a carton. The provision of alternating straps and cut holes in the folding zones greatly reduces the forces needed to fold a double corrugated multi ply corner post so as to simplify the machine formation and subsequent erecting of the corner posts.

Since many changes and variations of the disclosed embodiments of the invention may be made without departing from the inventive concept, it is not intended to limit the invention otherwise than as required by the appended claims.

What is claimed is:

1. A blank of corrugated paperboard material adapted to be folded into a multi ply corner post, said blank comprising:

(a) a first edge flap;

(b) a first panel adjacent to said first edge flap and foldably connected thereto by means of a first folding zone comprising a series of alternating straps and cut out holes;

(c) a second panel adjacent to said first panel and foldably connected thereto by means of a first fold line;

(d) a third panel adjacent to said second panel and foldably connected thereto by means of a second folding zone, said second folding zone comprising a series of alternating straps and cut out holes, with the straps in said second folding zone being aligned with the cut out holes in said first folding zone, and with the cut out holes in said second folding zone being aligned with the straps in said first folding zone, said straps in said second folding zone each being bisected by a fold line extending between mid planes of said cut out holes in said second folding zone;

(e) a fourth panel adjacent to said third panel and foldably connected thereto by means of a second fold line; and (f) a second edge flap adjacent to said fourth panel and foldably connected thereto by means of a third folding zone, said third folding zone comprising a series of alternating straps and cut out holes, said straps in said third folding zone being aligned with said cut out holes in said first folding zone, and said cut out holes in said third folding zone being aligned with said straps in said first folding zone.

2. The blank of claim 1, wherein said first and second edge flaps are approximately equal in width to the width of said first, second, third and fourth panels.

3. The blank of claim 1, wherein each of said straps is provided with at least one scored fold line extending thereacross.

4. The blank of claim 1, wherein each of said first and second fold lines comprise a series of alternating cuts and scored lines.

5. The blank of claim 4, wherein said cuts are H-shaped.

6. The blank of claim 1, wherein said first panel is folded about said first fold line and disposed in face to face contact with said second panel with said first edge flap being disposed in face to face contact with said third panel and said first folding zone being disposed in overlying relationship with said second folding zone and said fourth panel is folded about said second fold line and disposed in face to face contact with said first edge flap and said second edge flap being disposed in face to face contact with and adhesively secured to said first panel to position said third folding zone in overlying relationship with said second folding zone whereby a flattened bulk shipment configuration of the corner post is formed.

7. The blank of claim 6 therein said flattened configuration of the corner post is folded about said overlying first, second and third folding zone to form a L-shaped erected configuration of the corner post.

* * * * *